US005935049A

United States Patent [19]

Hamm

[11] Patent Number: 5,935,049

[45] **Date of Patent: *Aug. 10, 1999**

[54] COLLAPSIBLE ABDOMINAL EXERCISER

[75] Inventor: Jack L. Hamm, Englewood, Colo.

[73] Assignee: LongBall Sports, Inc., Englewood, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/662,375

[22] Filed: Jun. 12, 1996

[51] Int. Cl.[6] ..... A63B 23/02

[52] U.S. Cl. ..... 482/140; 482/108; 482/131; 482/139; 482/909

[58] Field of Search ..... 482/10, 91, 84, 482/95, 105, 108, 131, 139, 140, 148, 908, 909, 142; D21/686–691; D24/64, 190; 128/845, 869, 870; 606/240

[56] References Cited

U.S. PATENT DOCUMENTS

| | | | |
|---|---|---|---|
| D. 323,218 | 1/1992 | Kamensky | D24/64 |
| D. 337,824 | 7/1993 | Campbell | D24/190 |
| D. 343,080 | 1/1994 | Kentner | D6/501 |
| 2,791,999 | 5/1957 | Bustamante | 482/10 |
| 3,735,983 | 5/1973 | Ortiz | 482/909 |
| 4,428,578 | 1/1984 | Kirkpatrick | 482/139 |
| 4,429,870 | 2/1984 | Gibbs | 482/139 |
| 4,621,809 | 11/1986 | Pearl | 482/104 |
| 4,778,173 | 10/1988 | Joutras | 482/108 |
| 4,807,873 | 2/1989 | Naquin | 482/139 |
| 4,863,158 | 9/1989 | Tassone | 482/140 |
| 5,007,633 | 4/1991 | Lemire | 482/142 |
| 5,169,372 | 12/1992 | Tecco | 482/140 |
| 5,192,254 | 3/1993 | Young | 482/909 |
| 5,242,355 | 9/1993 | Costa | 482/141 |
| 5,267,931 | 12/1993 | Faetini | 482/140 |
| 5,348,523 | 9/1994 | Blount | 482/142 |
| 5,378,217 | 1/1995 | D'Orta | 482/111 |
| 5,492,520 | 2/1996 | Brown | 482/140 |
| 5,584,786 | 12/1996 | Almeda | 482/140 |
| 5,599,261 | 2/1997 | Easley et al. | 482/140 |

*Primary Examiner*—Jeanne M. Clark
*Attorney, Agent, or Firm*—Swanson & Bratschun LLC

[57] ABSTRACT

An apparatus for facilitating abdominal exercise (10) which includes a frame (12) having a central portion (20) between left (14) and right (16) hand engaging portions, the left (14) and right (16) hand engaging portions extending forward from the central portion (20), the central portion and the left and right hand engaging portions being essentially co-planar. A receptacle (18) is attached to the central portion, the receptacle (18) having a concave back of a head receiving portion (50) and an elongate groove neck receiving portion (52) extending from the back of the head receiving portion (50), the receptacle (18) extending transverse the plane of the frame.

18 Claims, 7 Drawing Sheets

COLLAPSIBLE ABDOMINAL EXERCISER

BACKGROUND OF THE INVENTION

1. Technical Field

The present invention is directed toward exercise equipment and more particularly toward a collapsible abdominal exerciser.

2. Background Art

The fitness craze which has captivated the attention of ever increasing numbers of people in the United States and throughout the world has spawned an endless array of exercise equipment, some of it beneficial, much of it merely a gimmick of one sort or another. One particular area of concentration for manufacturers and promoters of exercise equipment has been abdominal exercisers. The majority of these abdominal exercisers are based upon the traditional sit-up. These abdominal exercisers generally promote themselves with claims of a quick and easy path to the illusive washboard stomach.

The age old form of abdominal exercise is the traditional sit-up. Sit-ups are generally performed by a person laying upon their back with their knees bent and their feet flat on the floor. The person then contracts the abdominal muscles to raise his/her head off of the ground. There are numerous variations on this basic exercise, which include varying the placement of the person's hands from behind the neck to crossed over the front of the persons chest and raising the shoulders only a few inches off the ground (commonly known as a "crunch") to touching the forehead to the knees. One common criticism of traditional sit-ups is the ease with which a person can cheat. For example, a person can throw his hands forward during execution of the sit-up to provide momentum which eases the lifting burden on the abdominal muscles. In addition, when executing a "crunch" sit-up, there is no objective indication to the person when he or she has completed a full sit-up. There is a known tendency during execution of a set of sit-ups to not fully complete sit-ups toward the end of the set, thereby lessening the effectiveness of the exercise.

One other common problem in performing sit-ups is strain or discomfort to the user's spine. Prolonged improper form in executing sit-ups can lead to chronic neck and back discomfort.

Finally, traditional sit-ups do not adequately concentrate the workout on the desired abdominal muscles. It has been found that the most effective sit-up is performed when the person's chin abuts his or her chest. However, even with the person's hands behind his head this a difficult if not impossible position to maintain and therefore traditional sit-ups fail to properly focus the workout.

There have been numerous abdominal exercisers sold over the years which attempt to address some of the problems with conventional sit-ups discussed above. However, the abdominal exercisers for addressing these problems have been found to be seriously wanting because they fail to address all of these concerns and therefore are at best simply providing inefficient and unfocused exercise, or at worse fail to provide adequate support for the user's spine and therefore create the potential for chronic discomfort for the user. In addition, these abdominal exercisers are often too bulky to be readily transported, thereby preventing many traveling users from enjoying their limited benefits while they are away from home.

The present invention is directed toward overcoming one or more of the problems discussed above.

SUMMARY OF THE INVENTION

One aspect of the present invention is an apparatus for facilitating abdominal exercise. The apparatus includes a frame having a central portion between left and right hand engaging portions, the left and right hand engaging portions extending forward from a central portion, the central portion and the left and right hand engaging portions being essentially co-planar. A receptacle is attached to the central portion, the receptacle having a concave back of a head receiving portion and an elongate groove neck receiving portion connected to the back of the head receiving portion, the receptacle extending transverse the plane of the frame. The frame may be generally U-shaped, with the central portion comprising the bottom of the U and the left and right hand engaging portions extending from the sides of the U. Preferably the left and right hand engaging portions are each a handle which extend divergingly from one another within the plane of the frame. Each handle may be telescopingly engaged with a side of the U shaped frame and the apparatus may further comprise means for securing each handle at a select rotative position relative to the U-shaped frame, whereby the handles can be rotated to extend divergingly from one another or convergingly toward one another and secured in place. In a preferred embodiment, the left and right hand engaging portions are hollow and a cap is operatively is associated with each of the left and right hand engaging portions, the cap being removable to permit placement of weights inside the hollow left and right hand engaging portions and reattachable to prevent removal of the weights from the hollow portion.

In another aspect of the invention incorporating a generally U-shaped frame, a U-shaped indicator bracket is telescopingly engaged with the U-shaped frame with the bottom of the U-shaped frame and the bottom of the U-shaped indicator oppositely disposed so as to form an essentially rectangular structure. A clamp is provided for securing the U-shaped indicator bracket extended a select distance from the U-shaped frame. An indicator is preferably provided along the bottom of the U of the U-shaped indicator bracket, the indicator being movable laterally along the bottom of the U-shaped bracket. A clamp is provided on the indicator for fixing the indicator at a select position laterally along the U-shaped bracket. A probe may extend from the indicator transverse the plane of the frame, the probe being extendable a select amount. The probe preferably has a sensor at its distal end which is electrically connected to the indicator to provide an electric signal to the indicator when the sensor strikes an object.

Yet another aspect of the present invention is an apparatus for facilitating abdominal exercise by a user which includes a generally U-shaped frame. A receptacle for receiving a portion of a neck and a portion of a back of the head of the user is attached to the inside bottom of the U-shaped frame. A pair of handles, attached to the end of each side of the U-shaped frame, extend divergingly from one another substantially within a plane of the U-shaped frame. The handles are spaced from the bottom of the U-shaped frame sufficiently that with the portion of the neck and the portion of the back of the head of a user received within the receptacle, the handles extend beyond the user's face. Each handle may be telescopingly engaged with the side of a U-shaped frame and extendable axially of the sides of the U-shaped frame to vary the distance the handles are spaced from the bottom of the U-shaped frame. A clamp is preferably provided for securing each handle a select distance from the bottom of the U-shaped frame. Each handle may also be rotatable axially relative to its corresponding side of the U-shaped frame so that the handles can be selectively rotated to extend convergingly toward or divergingly away from one another and secured at a select rotative position. A generally U-shaped indicator bracket may also be telescopingly engaged with the sides of the U-shaped frame to provide a generally rectangular structure. An indicator along the bottom of the U-shaped indicator bracket indicates when a sit-up has been properly executed by a user. The U-shaped indicator bracket is preferably adjustably extendable relative to the U-shaped frame.

Another aspect of the present invention is an apparatus for facilitating abdominal exercise comprising a substantially U-shaped tubular frame. A receptacle for receiving a portion of the neck and a portion of the back of a head of a user is attached to the inside bottom of the U-shaped frame. A pair of tubular handles having first and second straight portions joined by a curved portion are provided. The first straight portion of each handle is axially, telescopingly engaged with the side of the U-shaped frame. The handles are rotatable about an axis of the first portion between an operative position with the second straight portions of the handles extending divergingly from one another and a storage position with the handles extending convergingly toward one another. The handles are spaced from the bottom of the U-shaped frame sufficiently that with the handles in the operative position and the portion of the neck and the portion of the back of the head of the user received in the receptacle, the handles extend beyond the user's face. A clamp is provided for securing each handle in a select rotative position relative to the U-shaped frame. A generally U-shaped indicator bracket having an indicator movable laterally along the bottom of the U-shaped indicator bracket is telescopingly attached to the sides of the U-shaped frame to form an essentially rectangular structure. The U-shaped indicator bracket is extendable select variable distances from the U-shaped frame.

The apparatus for facilitating abdominal exercise of the present invention provides full and proper support to the neck and spine of the user. The apparatus maintains the user's chin against his/her chest and further positions the user's hands in a manner which maximizes the effectiveness of each sit-up executed using the apparatus. The apparatus provides an indication to a user when a sit-up has been properly executed so as to maximize the effectiveness of the apparatus. The apparatus is fully adjustable to accommodate users of differing body shapes. The apparatus is also collapsible to facilitate ease of storage and transport so that even users with busy travel schedules can maintain their exercise regiment. Because the apparatus can accommodate addition of weights, it can provide exercise to persons of varying physical condition and can be adapted to accommodate a user as his or her physical condition improves.

DETAILED DESCRIPTION OF THE PREFERRED EMBODIMENT

Figure 1:
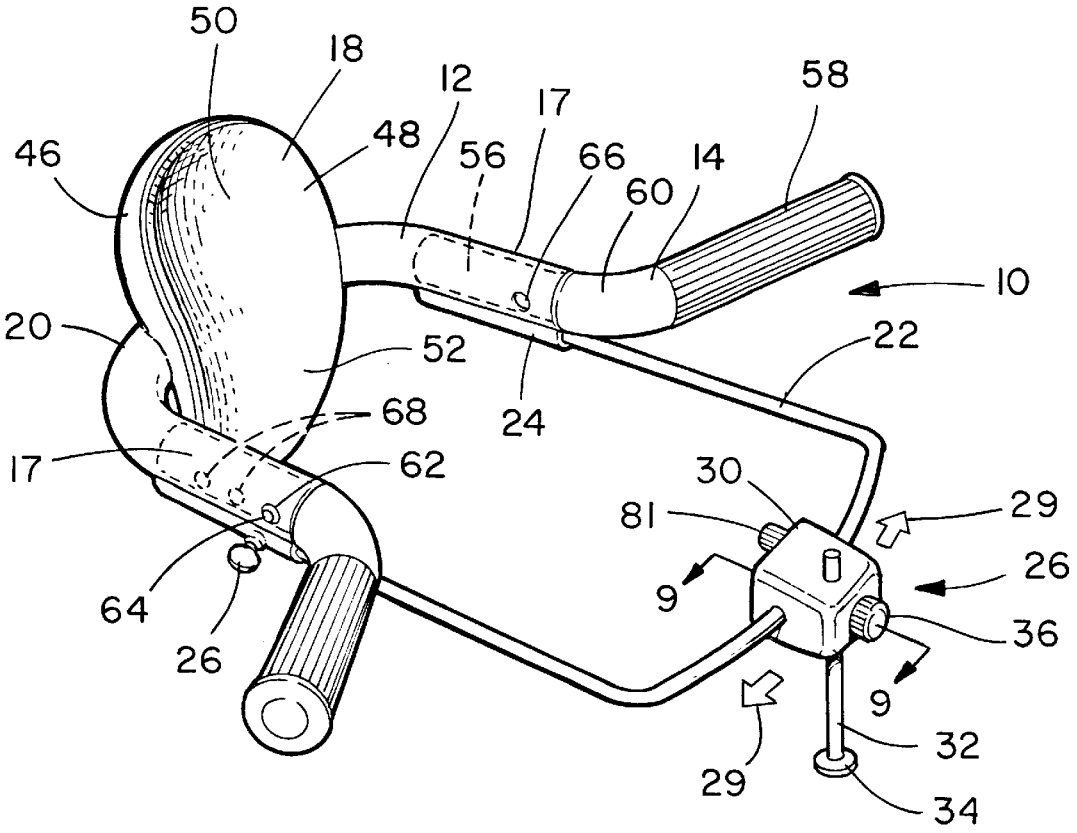
FIG. 1 is a perspective view of a preferred embodiment of the apparatus for facilitating abdominal exercise of the present invention.

An apparatus for facilitating abdominal exercise 10 is shown in its entirety in FIG. 1. The apparatus 10 includes a tubular generally U-shaped frame 12 having a pair of tubular handles 14, 16 which extend telescopingly from the distal ends of the sides 17 of U-shaped frame. A head and neck receptacle 18 is attached to the central or bottom portion 20 of the U of the U-shaped frame 12 and extends transverse a plane containing the U-shaped frame. A generally U-shaped indicator bracket 22 extends from the sides 17 of the U-shaped frame 12, creating an essentially rectangular structure. The sides of the U-shaped indicator bracket 22 are telescopingly connected to the U-shaped frame 12 by connector brackets 24 on the underside of the U-shaped frame 12 so that the distance the U-shaped indicator bracket 22 extends from the U-shaped frame 12 is variable. Some form of a clamp such as thumbscrew 26 cooperates between the connector brackets 24 and the U-shaped indicator bracket 22 to secure the U-shaped indicator bracket extended a select amount from the U-shaped frame 12.

Figure 9:
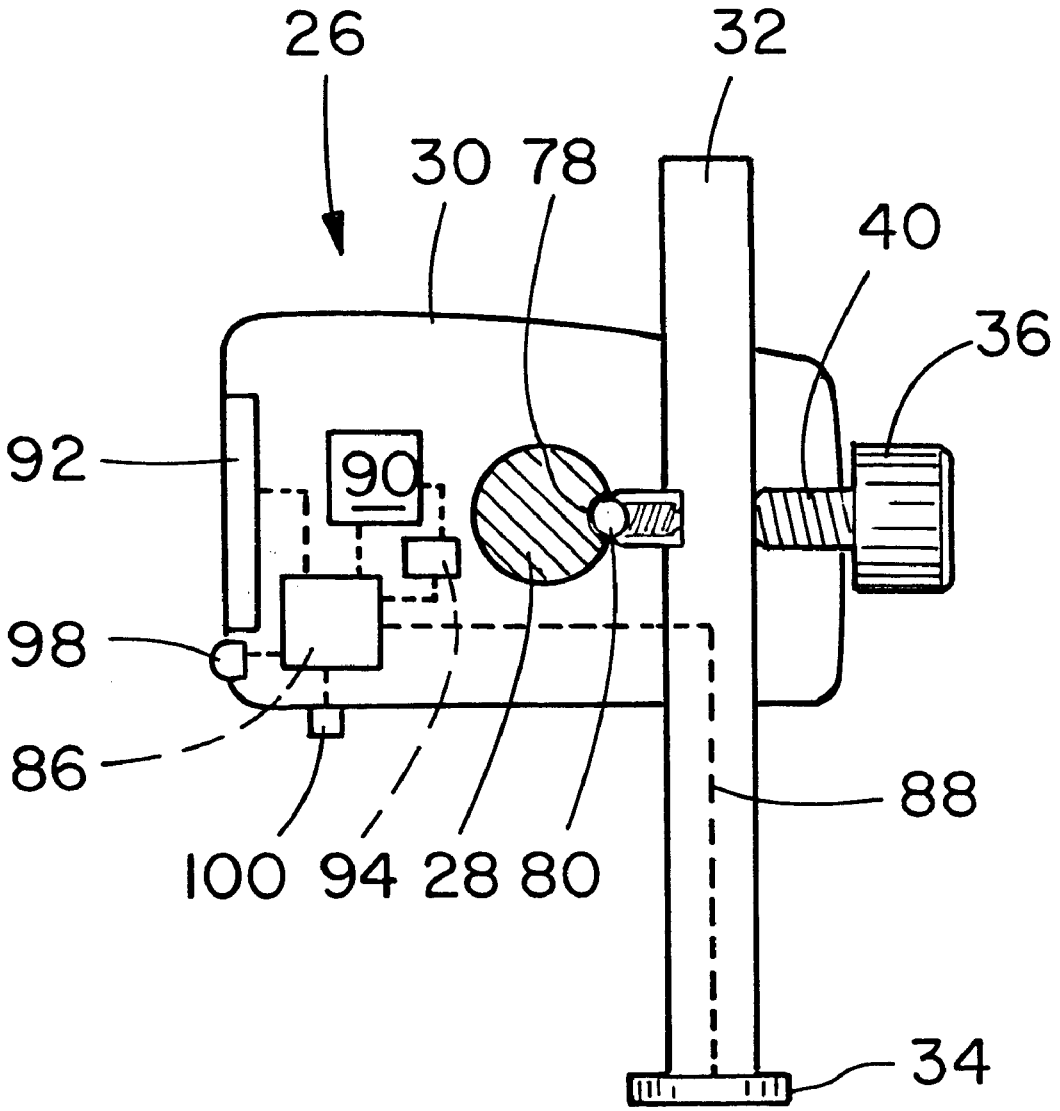
FIG. 9 is a cross-sectional schematic view of the indicator taken along line 9—9 of FIG. 1.

An indicator 26 is attached to the bottom 28 of the U-shaped indicator bracket 22. As illustrated by the arrows 29 in FIG. 1, the indicator 26 can slide laterally along the bottom 28 of the U-shaped indicator bracket 22. The indicator 26 includes a housing 30 and an extendable probe 32 having a sensor 34 at its distal end. The probe 32 can be extended or retracted relative to the housing 30. Referring to FIG. 9, a knob 36 forms the head of a bolt 40 which can be axially rotated to be brought into or out of contact with the probe 32 to selectively secure the probe 32 extended a select amount or to release the probe.

Figure 2:
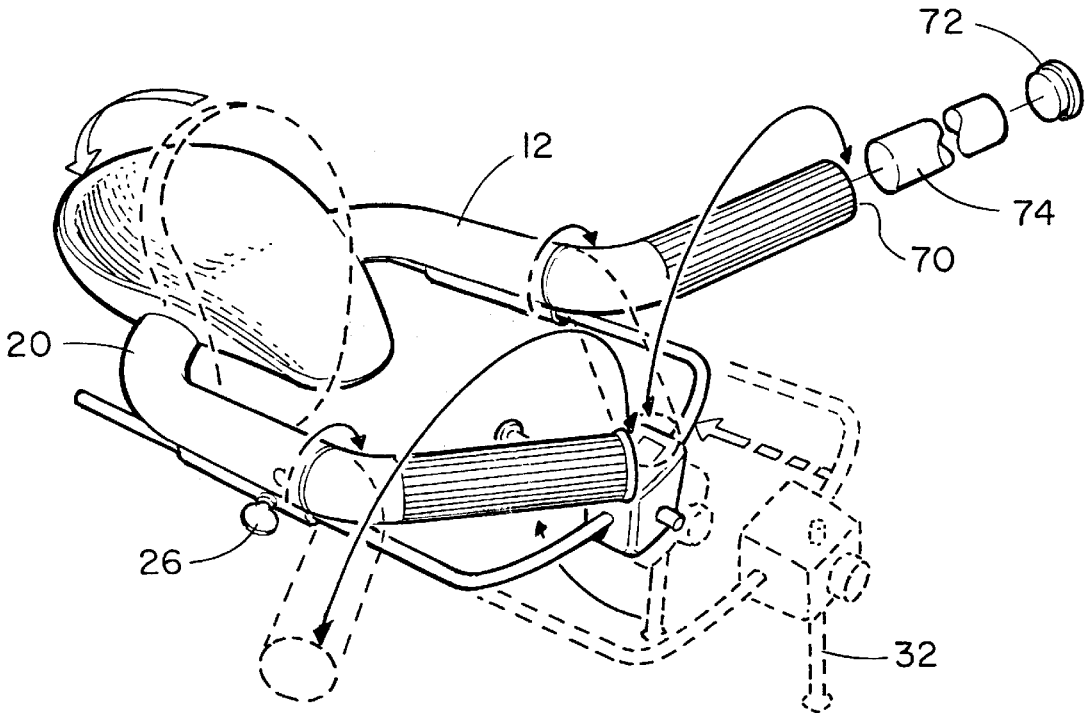
FIG. 2 is a perspective view of the apparatus for facilitating abdominal exercise of FIG. 1 illustrating the adjustability and collapsibility of the apparatus.
Figure 10:
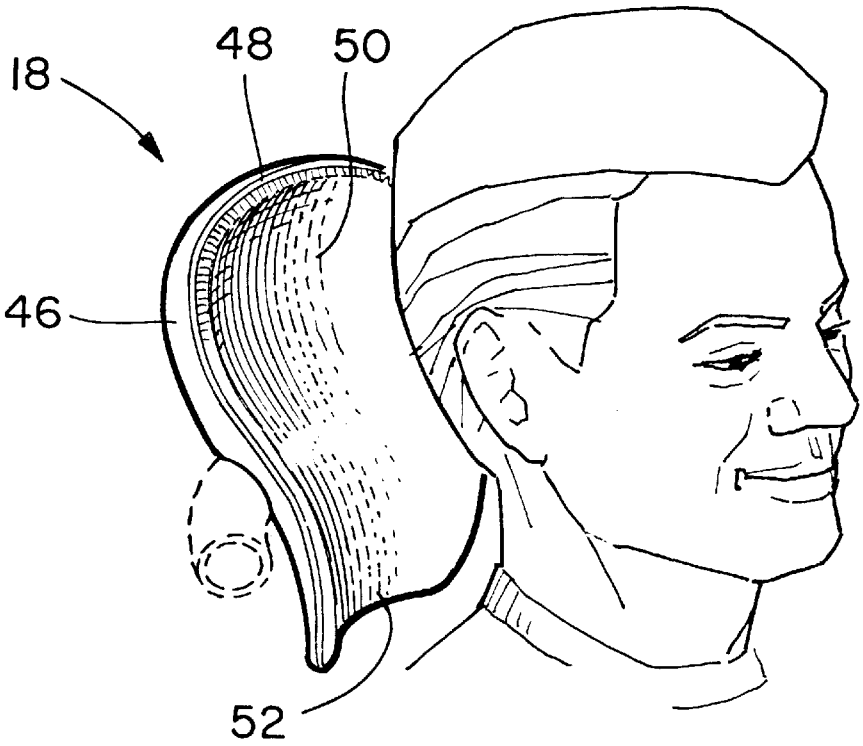
FIG. 10 is a perspective view of the head and neck receptacle in proximity to the back of the head and neck of a user.
Figure 11:
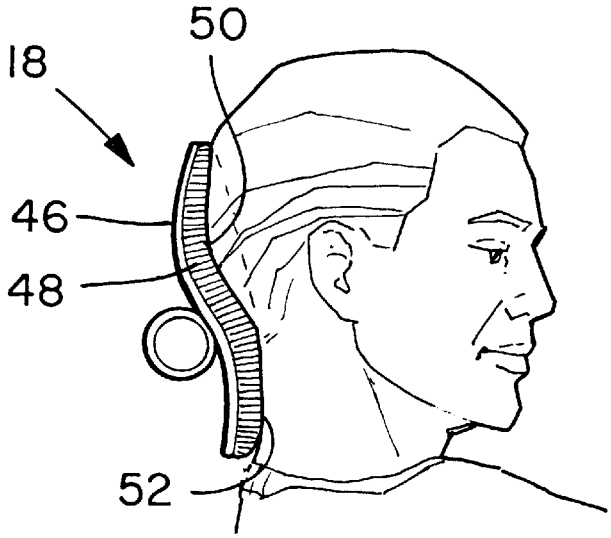
FIG. 11 is a cross-sectional view of the head and neck receptacle engaging the back of the head and neck of a user.

With continued reference to FIG. 1 and reference to FIGS. 9 and 10, the head and neck receptacle 18 includes a rigid backing 46 and cushion 48. Both the rigid backing 46 and the cushion 48 are formed to define a concave back of the head receiving portion 50 an elongate groove neck receiving portion 52 which extends from the back of the head receiving portion 50. FIG. 11 illustrates the concave back of the head receiving portion 50 and elongate groove neck receiving portion 52 engaging the head of a user. As illustrated in FIG. 1, in an operative position the head and neck receptacle 18 extends transverse a plane of the U-shaped frame 12. Referring to FIG. 2, the head and neck receptacle 18 can be pivoted about the axis of the bottom 20 of the U of the U-shaped frame 12 so as to lay generally parallel to the plane of the U-shaped frame 12. A clamp or similar device (not shown) is provided on the rigid backing 46 of the head and neck receptacle 18 to maintain the head and neck receptacle 18 in a select pivotal position.

As illustrated in FIG. 1, each of the handles 14, 16 comprise first and second straight portions 56, 58 joined by a curved portion 60. The first straight portion 56 is telescopingly received in one of the distal ends of the sides of the U-shaped frame 12. The second straight portion 58 extends outwardly of the U-shaped frame 12. In an operative position, as illustrated in FIG. 1, the second straight portion 58 of the handles 14, 16 extend divergingly from one another generally within the plane of the U-shaped frame 12. The handles 14, 16 are, however, rotatable about the axis of the sides of the U-shaped frame 12 so that they can be rotated to extend convergingly toward one another as illustrated in FIG. 2 in order to compact the apparatus for shipping or transport. A structure such as a spring detent 62 is provided on the first straight portion of the handle and the detent 62 can then be positioned to extend out of a hole 64 in the U-shaped frame 12 so as to maintain the handles 14, 16 in a select rotated position. A second hole 66 can be provided on the inner portion of the U-shaped frame 12 so as to secure the handles extending convergingly inward. The handles 14, 16 can also be extended further outward or inward relative to the distal ends of the U-shaped frame 12 so as to accommodate user's of varying sizes. As illustrated in FIG. 1 by phantom lines, additional spring detents 68 can be provided to secure the handles extended a select amount. Of course, clamps or other fasteners could be substituted for the spring detent 62 described herein to secure the handles at a select rotative and extended position as will be readily appreciated by those skilled in the art.

Referring to FIG. 2, the second straight portion 58 of each of the handles 14, 16 is hollow and the distal end 70 is covered by removable, threadably engaged cap 72. The cap 72 is removable so that a cylindrical weight 74 can be inserted into the distal end 70 so as to increase the resistance to executing a sit-up. In the preferred embodiment, several different weights 74 are provided with each having a different mass so that the user can increase resistance to performing a situp as desired.

As illustrated by the arrows 29 in FIG. 1, the indicator 26 slides laterally along the bottom of the U-shaped indicator bracket 22. Referring to FIG. 9, in a preferred embodiment, the bottom 28 of the U of the U-shaped indicator bracket 22 has an elongate groove 78 along its length. Within the housing 30 of the indicator 26 is a spring biased detent 80. The indicator 26 is rotatable about the bottom 28 of the U of the U-shaped indicator bracket 22 so that the probe 32 can be made to extend parallel to the plane of the U-shaped frame 12 instead of transverse the plane of the U-shaped frame, as seen in FIG. 2. As can be readily appreciated, this further compacts the structure and improves transportability. The elongate groove 78 and spring bias detent 80 are in engagement when the indicator is aligned in its operative position as illustrated in FIG. 1 as shown in phantom lines in FIG. 2. Thus, the indicator can be readily properly aligned for use. Once the detent 80 is brought into engagement with the groove 78, a clamp 81 or the like can be used both to secure the indicator at a desired point along the length of the bottom 28 of the U of the U-shaped bracket 22 and to prevent rotation of the indicator 26 about the bottom 28 of the U of the U-shaped bracket 22.

Figure 8:
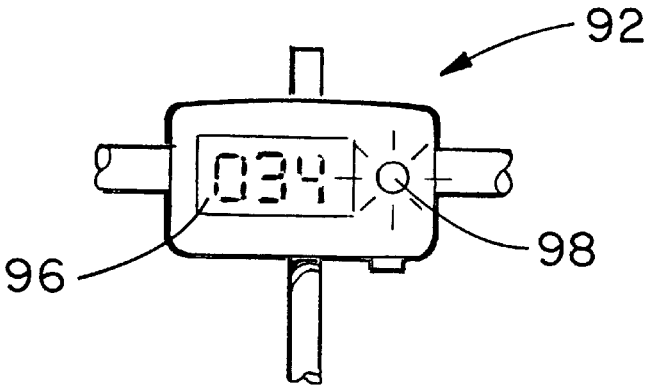
FIG. 8 illustrates the indicator for an apparatus for facilitating abdominal exercise in accordance with the present invention.

Referring again to FIG. 9, the electronics of the indicator 26 are shown in schematic form. The sensor 34 is electrically coupled to microprocessor 86 by connector 88. The microprocessor 86 is in turn electrically coupled to a power supply 90. The power supply 90 in turn is electrically coupled to the display 92 and an audio generator 94 such as a beeper. The display 92 and audio generator 94 are also electrically coupled to the microprocessor 86. The visual display 92 is illustrated in FIG. 8. The visual display 92 includes a numeric display 96 and a light 98. The microprocessor 86 is coupled to a control 100 which allows the microprocessor 86 to be set as desired. For example, the microprocessor 86 can be set to 0 and then to count consecutively each time the sensor 34 contacts an object. Alternatively, a select number can be entered to the microprocessor 86 and the microprocessor 86 will then count downward each time the sensor 34 contacts an object. If desired, the sensitivity of the sensor 34 could also be adjusted. The count of the microprocessor 86 is displayed on the numeric display 96. If desired, the light 98 can be illuminated each time the sensor 34 contacts an object or only upon completion of a preset goal.

Figure 7:
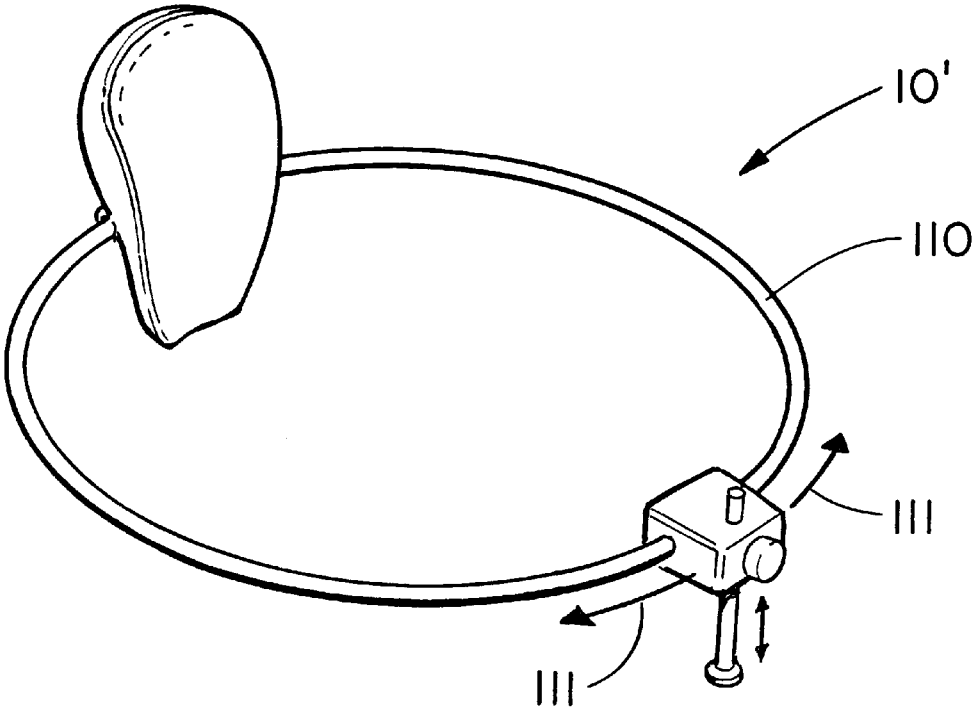
FIG. 7 is an alternate embodiment of a an apparatus for facilitating abdominal exercise in accordance with the present invention.

An alternate embodiment of the apparatus for facilitating proper execution of a sit-up 10' is illustrated in FIG. 7. In this embodiment the U-shaped frame 12, the handles 14, 16 and the U-shaped indicator bracket 22 are replaced by a circular frame 110. The indicator 26 can be slid lengthwise of the circular frame as indicated by the arrows 111 of FIG. 7. While this design does not have as many adjustability or compactability features of the preferred embodiment illustrated in FIG. 1, this design does have the advantage of ease of manufacture.

Figure 3:
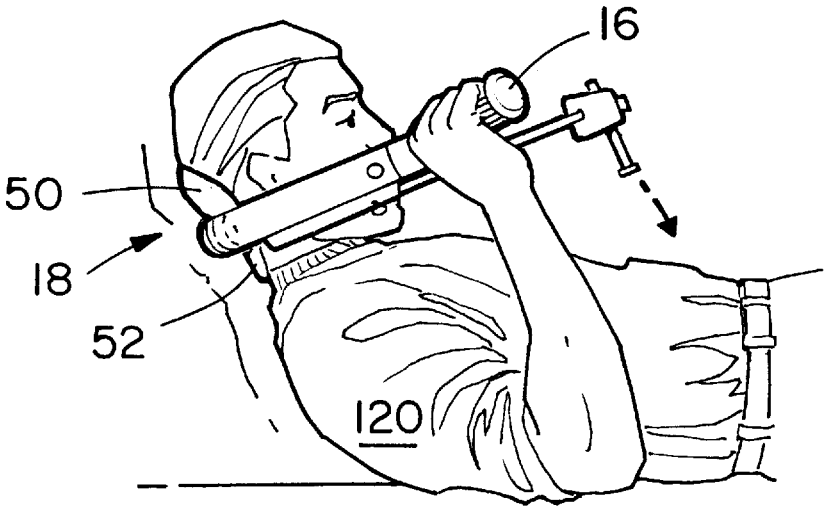
FIG. 3 illustrates a user beginning execution of a sit-up using the apparatus of FIG. 1.
Figure 4:
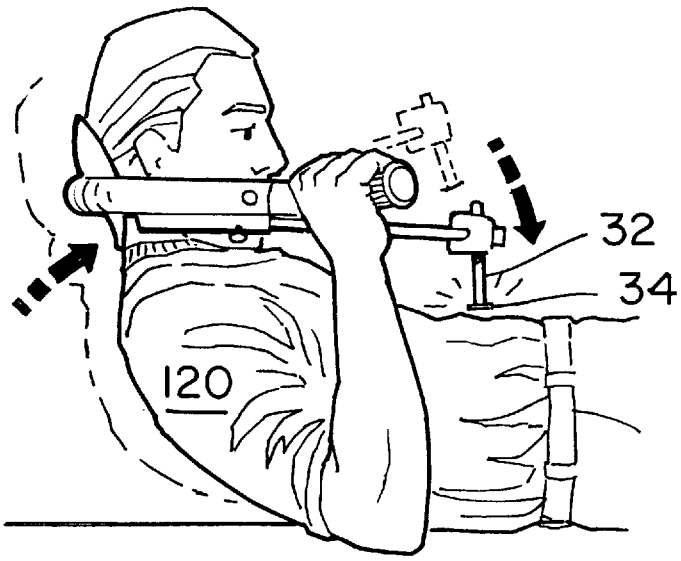
FIG. 4 illustrates a user completing execution of a sit-up using the apparatus of FIG. 1.

Executing of abdominal exercise using the apparatus 10 of the present invention by a user 120 is illustrated in FIGS. 3–6. FIG. 3 illustrates a starting position. In the starting position the receptacle 18 is positioned with the back of the user's head engaged in the concave back of the head receiving portion 50 and the neck of the user received in the elongate groove neck receiving portion 52. The user then engages his right hand with the right hand handle 16 and his left hand with the left handle 14 (not shown in FIG. 3), resulting in the user's hands being about 2–6 inches in front of the user's face. The user's chin is pulled forward to contact with the user's chest as viewed in FIG. 3. In use, this position is naturally obtained and easily maintained by placing the hands on the left and right grips 14, 16 and pulling forward slightly. The user then contracts his abdomen until, as viewed in FIG. 4, the sensor 34 on the distal end of the probe 32 contacts the user's abdomen. This motion is very similar to that of a traditional sit-up. At this point, if the microprocessor 86 of the indicator 26 is so programmed, an additional number will be accounted for by the display and perhaps the light 98 will be illuminated or the audio generator 94 activated to indicate execution of a proper sit-up. The user then returns to the starting position of FIG. 3 and repeats the procedure until the desired number of repetitions is completed. The exercise illustrated in FIGS. 3 and 4 is used to strengthen the user's abdominal muscles. If the user bends his knees and keeps his feet on the floor, the upper abdominal muscles are predominantly exercised. If the user lifts his feet, the lower abdominal muscles are focused upon.

As discussed above, the probe 32 can be extended or retracted as desired. The further the probe is retracted, the harder the user must work to execute the exercise. In addition, the probe 32 can be retracted for user's with larger abdomens so that they can still receive an adequate workout.

Figure 5:
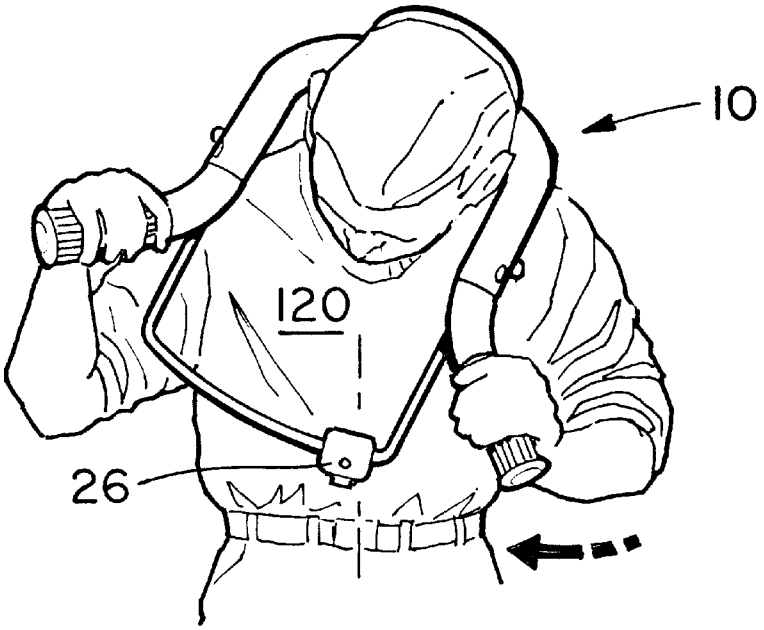
FIG. 5 illustrates the indicator in the apparatus of FIG. 1 laterally displaced and a user using the apparatus to focus exercise on his left obliques.
Figure 6:
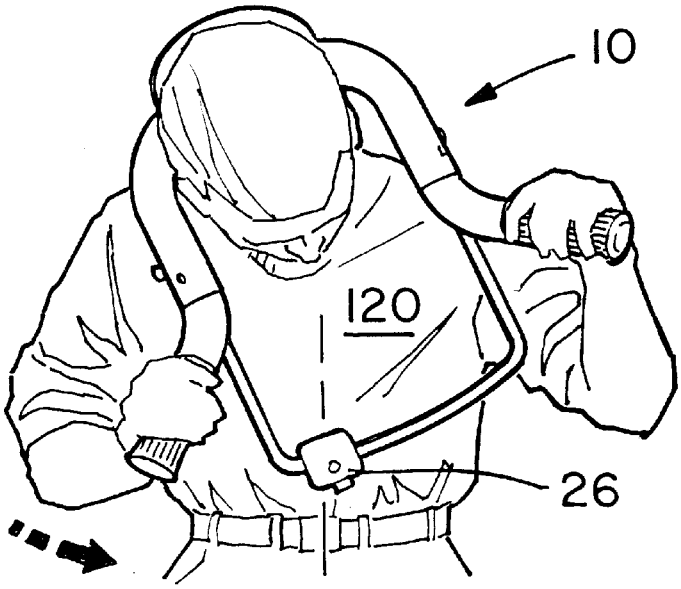
FIG. 6 is similar to FIG. 5, only the indicator is laterally displaced the opposite direction and the user is using the apparatus to focus exercise on his right obliques.

FIGS. 5 and 6 illustrate repositioning of the indicator 26 to focus the exercise on the left and right obliques, respectively. Referring to FIG. 5, to focus exercise on the left obliques the indicator 36 is slid along the bottom of the U to the left hand side and then clamped into place. While contracting the abdominal muscles the user now turns slightly to his left as indicated and brings the probe 32 into contact with his abdomen. Referring to FIG. 6, to exercise his right obliques the user slides the indicator 26 laterally to the right side of the bottom portion of the U of the U-shaped indicator bracket 22 and turns to his right as he contracts his stomach muscles.

Abdominal exercises, which closely resemble sit-ups, conducted using the apparatus 10 in the manner discussed above provide an extremely well focused and intense workout of the user's upper and lower abdominal muscles as well as his right and left obliques. By maintaining the user's chin in contact with the chest, the effectiveness of the workout is intensified. The head and neck receptacle, which is designed to cup the head and neck of the user, is self aligning and provides support for the user's spine which prevents harmful strain to the user's neck and spine. The indicator/sensor not only provides a convenient way of checking the number of repetitions performed, but also provides an indication of a properly executed repetitions so as to assure a proper workout is being achieved. Because weights can be added to the apparatus, as abdomen muscles are strengthened, a vigorous workout can continue to be maintained. The apparatus is fully adjustable to accommodate user's of varying sizes. In addition, the apparatus can be collapsed and flattened out for ease of storage and transportation. Finally, the apparatus can be made from easily obtained and easily fabricated materials, making it a relatively inexpensive aid for facilitating abdominal exercise.

What is claimed is:

1. An apparatus for facilitating abdominal exercise comprising:

a generally U-shaped frame, the frame including a central portion at the bottom of the U and a pair of handles extending divergingly substantially within a plane defined by the frame from the sides of the U; and a receptacle attached to the central portion and extending transverse the plane of the frame the receptacle having a concave cavity configured to nestingly receive the back of a user's head and an elongate groove extending downward from the concave cavity configured to nestingly receive the back of a user's neck, the concave cavity and the elongate groove cooperating to receive and support the back of the head and the neck of a user and to operatively position the receptacle when a user performs an abdominal exercise.

2. The apparatus of claim 1 wherein each handle is telescopingly engaged with a side of the U-shaped frame, the apparatus further comprising means for selectively securing each handle at a first rotative operative position with the handles extending divergingly from one another within the plane of the frame and a second rotative storage position with the handles extending convergingly toward one another.

3. The apparatus of claim 1 wherein each handle includes means for attaching weights.

4. The apparatus of claim 3 wherein the weight attaching means comprises:

each handle being hollow and a cap operatively associated with each handle, the cap being removable to permit access inside the handle and reattachable to prevent access to and from the handle; and a plurality of weights sized to be received inside the handles.

5. The apparatus of claim 1 further comprising:

a generally U-shaped indicator bracket;

an indicator extending from along a bottom of the U of the U-shaped indicator bracket; and means along the sides of the U-shaped frame for telescopingly receiving the sides of the U-shaped indicator bracket, the indicator extending from the bottom of the U of the U-shaped bracket so as to provide a signal when the indicator contacts a user's abdomen upon proper execution of a sit-up.

6. The apparatus of claim 5 further comprising means for securing the U-shaped indicator bracket with the U-shaped indicator bracket extended a select amount from the telescopingly receiving means.

7. The apparatus of claim 5 wherein the indicator slidably receives the bottom of the U of the U-shaped indicator bracket and is movable laterally along the bottom of the U of the U-shaped indicator bracket, the apparatus further comprising means between the indicator and the bottom of the U of the U-shaped bracket for fixing the indicator at a select position laterally along the bottom of the U of the U-shaped bracket.

8. An apparatus for facilitating abdominal by a user comprising:

a generally planer U-shaped frame;

a receptacle attached to and extending transverse the plane of the U-shaped frame, the receptacle having a concave configured to nestingly receive the back of a user's head and a elongate groove extending downward from the concave cavity configured to nestingly receive the back of the user's neck, the concave cavity and the elongate groove cooperating to receive and support the back of the head and neck of a user and to operatively position the receptacle when a user performs and abdominal exercise; and a pair of handles, one attached to the end of each side of the U-shaped frame, the handles extending divergingly from one another substantially within a plane of the U-shaped frame, each handle being spaced from the bottom of the U-shaped frame and telescopingly engaged with a side of the U-shaped frame, each handle being extendable axially of the sides of the U-shaped frame to vary a select distance the handle is spaced from the bottom of the U-shaped frame, the apparatus further comprising means for securing each handle at the selected distance from the bottom of the U-shaped frame.

9. The apparatus of claim 8 wherein each handle is rotatable axially relative to its corresponding side of the U-shaped frame so that the handles can be rotated to extend convergingly toward or divergingly away from one another, the apparatus further comprising means for securing each handle at a select rotative position relative to the corresponding side of the U-shaped frame.

10. The apparatus of claim 8 further comprising:

a generally U-shaped indicator bracket;

indicator means extending from along a bottom of the U of the U-shaped indicator bracket for indicating when a sit-up has been properly executed by a user; and means along the sides of the U-shaped frame for telescopingly receiving the sides of the U-shaped indicator bracket, the indicator extending from the bottom of the U of the U-shaped bracket so as to provide a signal when the indicator contacts a user's abdomen upon proper execution of a sit-up.

11. The apparatus of claim 10 further comprising means for securing the U-shaped indicator bracket with the U-shaped indicator bracket extended a select amount from the telescopingly receiving means.

12. The apparatus of claim 11 wherein the indicator means slidably receives the bottom of the U of the U-shaped indicator bracket and is movable laterally along the bottom of the U of the U-shaped indicator bracket, the apparatus further comprising means between the indicator and the bottom of the U of the U-shaped bracket for fixing the indicator at a select position laterally along the bottom of the U of the U-shaped bracket.

13. The apparatus of claim 10 wherein the indicator means comprises:

a housing;

means within the housing responsive to an electric signal for notifying a user the indicator has contacted the user's abdomen;

an axially extendable probe received in the housing, the probe extending transverse a plane defined by the U-shaped indicator bracket;

means between the housing and the extendable probe for holding the probe extended from the housing a select distance;

a sensor at a distal end of the probe for producing an electric signal in response to the sensor contacting an object; and means electrically connecting the sensor and the notifying means.

14. The indicator means of claim 13 wherein the notifying means comprises a visual display including a indicator for displaying a number of times the indicator has contacted the user's abdomen.

15. The apparatus of claim 8 further comprising;

weights configured for attachment to the handles; and means for attaching the weights to the handles.

16. The apparatus of claim 8 further comprising:

the handles being hollow with an open distal end;

weights configured to be received in the open distal ends of the handles; and a removable cap for permitting placement of the weights in the open distal ends of the handles, the cap being and reattachable over the open distal ends of the handles for preventing the weights from escaping the hollow portion.

17. An apparatus for facilitating abdominal exercise comprising:

a substantially U-shaped tubular frame;

a receptacle attached to the inside bottom of the U-shaped frame, the receptacle having a concave cavity configured to nestingly receive the user's back of a user's head and an elongates groove extending downward from the concave cavity configured to nestingly receive the back of a user's neck, the concave cavity and the elongate groove cooperating to receive and support the back of the head and neck of a user and to operatively position the receptacle when a user performs and abdominal exercise;

a pair of tubular handles having first and second straight portions joined by a curved portion, the first straight portion of each handle being axially, telescopingly engaged with a side of the U-shaped frame, the handles being rotatable about an axis of the first portion between an operative position with the second straight portions of the handled extending divergingly from one another and a storage position with the handles extending convergingly toward one another, the handles being spaced from the bottom of the U-shaped frame a select distance; and means associated with each handle for securing each handle at a select rotative position relative to the U-shaped frame.

18. The apparatus of claim 17 further comprising:

a generally U-shaped indicator bracket;

indicator means extending from along a bottom of the U of the U-shaped indicator bracket; and means along the sides of the U-shaped frame for telescopingly receiving the sides of the U-shaped indicator bracket, the indicator extending from the bottom of the U of the U-shaped bracket so as to provide a signal when the indicator contacts a user's abdomen upon proper execution of a sit-up.

* * * * *